US006824481B1

(12) United States Patent
Nye et al.

(10) Patent No.: US 6,824,481 B1
(45) Date of Patent: Nov. 30, 2004

(54) IMPACT TRANSMITTING STRIKE PLATE FOR A BASKETBALL GOAL ASSEMBLY

(75) Inventors: S. Curtis Nye, Clinton, UT (US); David C. Winter, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/319,970

(22) Filed: Dec. 16, 2002

Related U.S. Application Data

(60) Provisional application No. 60/340,195, filed on Dec. 14, 2001.

(51) Int. Cl.[7] ..... A63B 63/08
(52) U.S. Cl. ..... 473/481
(58) Field of Search ..... 473/481, 433, 473/472, 479, 482–488, 48; 248/640, 690–691, 672; 52/508–511; 404/10

(56) References Cited

U.S. PATENT DOCUMENTS

| | | | | | |
|---|---|---|---|---|---|
| 1,924,811 | A | | 8/1933 | Schulz | |
| 2,986,395 | A | | 5/1961 | Sheftel | |
| 3,329,427 | A | | 7/1967 | Bearson | |
| 3,427,025 | A | | 2/1969 | Procter | |
| 3,586,324 | A | | 6/1971 | Bearson | |
| 3,765,676 | A | | 10/1973 | Bearson et al. | |
| 3,788,642 | A | | 1/1974 | Matras et al. | |
| 3,841,631 | A | | 10/1974 | Dolan | |
| 4,111,420 | A | | 9/1978 | Tyner | |
| 4,285,518 | A | * | 8/1981 | Pearo | 473/481 |
| 4,320,896 | A | * | 3/1982 | Engle et al. | 473/481 |
| 4,330,101 | A | | 5/1982 | Andersen | |
| 4,395,040 | A | | 7/1983 | White | |
| 4,438,923 | A | | 3/1984 | Engle et al. | |
| 4,441,709 | A | | 4/1984 | Schroeder et al. | |
| 4,583,732 | A | | 4/1986 | Allen | |
| 4,676,503 | A | | 6/1987 | Mahoney | |
| 4,723,777 | A | | 2/1988 | Jolly | |
| 4,781,375 | A | | 11/1988 | Nye | |
| 4,798,381 | A | | 1/1989 | Dadbeh | |
| 4,801,142 | A | | 1/1989 | Friesen | |
| 4,805,904 | A | | 2/1989 | Nye | |
| 4,846,469 | A | | 7/1989 | Nye | |
| 4,881,734 | A | | 11/1989 | Nye | |
| 5,037,092 | A | * | 8/1991 | Blackburn | 473/481 |
| 5,066,007 | A | | 11/1991 | Niver | |
| 5,106,084 | A | | 4/1992 | Vaught | |
| 5,211,393 | A | | 5/1993 | Rolffs et al. | |
| 5,255,910 | A | * | 10/1993 | Simonseth | 473/481 |
| 5,318,289 | A | | 6/1994 | Mahoney et al. | |
| D350,797 | S | | 9/1994 | Curtis | |
| 5,375,835 | A | | 12/1994 | Van Nimwegen et al. | |
| D362,881 | S | | 10/1995 | Schickert et al. | |
| 5,464,207 | A | | 11/1995 | Boitano | |
| 5,465,957 | A | | 11/1995 | Schroeder | |
| 5,478,068 | A | | 12/1995 | Schroeder | |
| 5,503,390 | A | | 4/1996 | Hall | |
| 5,573,237 | A | | 11/1996 | Van Nimwegen et al. | |
| 5,586,759 | A | | 12/1996 | Fitzsimmons et al. | |
| 5,601,284 | A | | 2/1997 | Blackwell et al. | |

(List continued on next page.)

*Primary Examiner*—Steven Wong
*Assistant Examiner*—M. Chambers
(74) *Attorney, Agent, or Firm*—Workman Nydegger

(57) ABSTRACT

A basketball goal assembly includes a basketball goal with a strike plate. The strike plate preferably includes a rebound surface support that is sized and configured to help prevent the backboard from undesirably flexing or bending. In addition, the strike plate may allow forces to be directly transmitted from the backboard to other structures such as a backboard bracket or goal support structure. The strike plate may also have one or more flexural supports that brace the strike plate against flexure so that impact received from the rebound surface via the rebound surface support does not excessively bend the strike plate.

11 Claims, 4 Drawing Sheets

U.S. PATENT DOCUMENTS

| | | | | | |
|---|---|---|---|---|---|
| 5,632,480 | A | | 5/1997 | Davis et al. | |
| 5,695,417 | A | | 12/1997 | Winter et al. | |
| 5,720,679 | A | | 2/1998 | Schroeder | |
| 5,738,601 | A | | 4/1998 | Hughes | |
| D399,895 | S | | 10/1998 | Schickert et al. | |
| 5,816,955 | A | | 10/1998 | Nordgran et al. | |
| 5,830,090 | A | | 11/1998 | Fitzsimmons et al. | |
| 5,836,838 | A | | 11/1998 | Van Nimwegen et al. | |
| 5,879,247 | A | | 3/1999 | Winter et al. | |
| 5,902,198 | A | * | 5/1999 | Martin et al. | 473/481 |
| 5,947,847 | A | | 9/1999 | Van Nimwegen et al. | |
| 6,053,826 | A | * | 4/2000 | Koole | 473/485 |
| 6,135,901 | A | | 10/2000 | Van Nimwegen | |
| 6,142,891 | A | | 11/2000 | Winter et al. | |
| 6,155,938 | A | | 12/2000 | Mower | |
| 6,186,911 | B1 | | 2/2001 | Manthey | |

* cited by examiner

IMPACT TRANSMITTING STRIKE PLATE FOR A BASKETBALL GOAL ASSEMBLY

CROSS-REFERENCE TO RELATED APPLICATIONS

The present application claims priority to and the benefit of U.S. Provisional Patent Application Ser. No. 60/340,195, entitled Impact Transmitting Strike Plate for a Basketball Goal Assembly, which was filed on Dec. 14, 2001, and is hereby incorporated by reference in its entirety.

BACKGROUND OF THE INVENTION

1. Field of the Invention

The present invention is generally directed towards a basketball system and, in particular, to a basketball goal assembly with a strike plate that can be used to support a rebound surface of a basketball goal and facilitate attachment of a rim assembly to the basketball goal.

2. Description of Related Art

Basketball is an increasingly popular sport in the United States and throughout the world. Basketball may be played in informal games and in organized leagues. For example, many cities, counties and other entities sponsor recreational and instructional leagues where people of various ages can participate in the sport of basketball. Some leagues allow children that are as young as five and six years old to participate, and other leagues allow much older adults to play basketball.

The game of basketball typically includes a court with a generally flat and level playing surface and a basketball goal located at each end of the court. The basketball goal typically includes a support pole with a backboard and rim or hoop attached to the top of the support pole. The rim or hoop is normally located ten feet above the playing surface and the hoop is rigidly mounted to the basketball backboard. The face of the backboard is positioned perpendicular to the playing surface and the hoop is positioned perpendicular to the backboard and parallel to the playing surface. The mounting of the hoop to the backboard must be sufficiently rigid so that the hoop is capable of withstanding various forces and impacts during the game of basketball. For example, the hoop must remain in a generally stationary position so that the basketball rebounds and bounces off the rim in a consistent, dependable manner. In addition, the hoop must be able to withstand various impacts by the players during the game.

In recent years it has become increasingly popular to "dunk" the basketball in which the basketball is thrown through the hoop with great force. In particular, the basketball is thrown through the hoop from a position above the rim. While it is possible to dunk the basketball without the basketball or the player touching the rim, it is not uncommon for a player to strike the rim with the basketball and/or his or her hands and arms while dunking the basketball. In addition, a player may even grab and/or suspend themselves from the rim during the game or while practicing. These forces caused by dunking the basketball and players grabbing or suspending themselves from the rim impart substantial forces on the goal.

If the force applied to the basketball rim is of sufficient magnitude, many problems could result. For example, if the basketball backboard is constructed from tempered glass, the force applied to the goal may shatter the glass. This may result in injury to players surrounding the goal and spectators in the immediate area. In addition, the backboard has to be replaced before the game can be continued. Unfortunately, replacing the glass backboard requires a substantial amount of time and that results in an unacceptable delay of the basketball game. Additionally, it can be very expensive to replace glass backboards each time they are damaged.

Known basketball backboards are also constructed from materials other than tempered glass. For example, known basketball backboards may also be manufactured using thermoformed plastic. Thermoformed plastic is a relatively strong material, but it is also brittle. The brittle nature of the thermoformed plastic makes it susceptible to cracking or shattering upon impact. Additionally, thermoformed plastic backboards often require the use of strengthening ribs and reinforcement structures in order to increase the stiffness and rigidity of the backboard. These ribs and reinforcement structures detract from the aesthetics of the backboard and add to the complexity of the design and manufacturing process. Further, many thermoformed plastic basketballs are formed from two or more pieces that must be assembled together. Accordingly, thermoformed plastic backboards often require additional assembly and added parts such as fasteners. Therefore, thermoformed plastic backboards are relatively costly to manufacture.

Basketball backboards constructed from thermoformed plastic are generally more resistant to shattering or breaking in comparison to tempered glass backboards. The forces applied to the rim when a player dunks the basketball or otherwise contacts the rim, however, may still damage rim or backboard even if the backboard is constructed from thermoformed plastic. In particular, it is not only possible to break or shatter the backboard by dunking the basketball, but it is also possible to bend or otherwise deform the backboard and/or hoop. For example, if sufficient force is applied to the hoop, the hoop may bend from its horizontal position into a deformed, angled configuration. This is very undesirable because the hoop must remain horizontal and parallel to the playing surface. After a hoop has been bent into a deformed position, it is very difficult, if not impossible, to restore the hoop to its original, horizontal position. Thus, the hoop must usually be replaced, which is often time consuming and difficult to accomplish. Further, because hoops used in connection with home, playground and portable basketball systems are often not as strong and durable as hoops used for professional basketball games, these hoops are more likely to be bent and deformed. Therefore, hoops used in connection with home, playground and portable basketball systems are more likely to be damaged and in need of replacement.

It is known use a basketball hoop that will "breakaway" or deflect from its original horizontal position when a threshold force is applied to the hoop in order to prevent damage to the hoop or backboard. In particular, when greater than a predetermined amount of force is applied to the rim, the rim is allowed to pivot downwardly before the rim or backboard is damaged. These known breakaway rims allow the hoop to maintain its horizontal position during regular play when forces such as the basketball bouncing off of the hoop are applied. The breakaway rims, however, deflect downwardly when a substantial amount of force is applied to the hoop, such as someone dunking a basketball, in order to absorb much of the energy applied to the hoop.

Conventional basketball goals may also include backboards that are constructed from lightweight materials which reduce manufacturing costs, shipping costs, and allow the basketball goal to be more easily assembled. For example, a conventional basketball goal may include a backboard with a metal or wooden frame. A relatively thin and lightweight rebound surface, which may be constructed of a transparent polymer such as acrylic, is attached to the frame to form the backboard. The transparent rebound surface may enhance the appearance of the basketball goal and it allows people to see through the backboard, which may provide the look and feel of professional basketball goal.

The thin and lightweight rebound surface, however, may bend noticeably and undesirably deflect when impacted by a basketball. For example, when players shoot the basketball during a game or practice, they will often intentionally try to bounce the basketball off the rebounding surface in order to "bank" the basketball into the goal. Additionally, the basketball will often bounce off the rim and strike the rebound surface during a game or practice. The bending or deflecting of the rebound surface is often undesirable because the basketball does not bounce or rebound off the rebound surface in a consistent manner. In particular, because one portion of the rebound surface may deflect or bend more than another portion of the rebound surface, the basketball will rebound differently according to which portion of the rebound surface is struck by the basketball ball. Disadvantageously, this causes the basketball to bounce or rebound in an unexpected and inconsistent manner.

The bending or deflecting of the rebound surface is often especially problematic near the center of the rebound surface because players will typically aim at or near the center of the rebound surface to score a basket. If the center portion of the rebound surface causes the basketball to bound or rebound in an inconsistent manner, then the game of basketball may be much more difficult to play. Unfortunately, the center portions of many conventional basketball backboards are not adequately supported because the rebound surfaces are only supported at the outer edges by the frame. Additionally, when a break-away type rim is used in conjunction with a conventional basketball goal, the movement of the rim may cause the rebound surface to undesirably move. For example, when a player dunks a basketball and the rim deflects, the rim will return to its normal position when the force is released. When the rim returns to its normal position, however, the rim may snap back against the center of the rebound surface when the rim is released and that will cause the rebound surface to deflect.

Conventional basketball goals may include additional struts or crossbars that are attached to the frame to provide support against undesirable bending or deflection of the rebound surface. Disadvantageously, these components increase the weight and cost of the basketball goal. Furthermore, these additional components, which are located behind the transparent rebound surface, are often unattractive and are potentially distracting because they can be seen through the transparent rebound surface.

BRIEF SUMMARY OF THE INVENTION

A need therefore exists for a basketball goal assembly that eliminates the above-described disadvantages and problems.

One aspect of the present invention is a basketball goal assembly that includes a support structure that is sized and configured to support the basketball goal assembly. A goal support structure is connected to the support structure and a basketball goal is connected to the goal support structure. The basketball goal preferably includes a backboard with a rebound surface and a backboard bracket connected to the backboard. A strike plate may be connected to the backboard bracket and the strike plate may include a rebound support surface that is sized and configured to support at least a portion of the rebound surface. A rim assembly, which includes a basketball rim or hoop, may also be connected to the strike plate.

Another aspect is the strike plate may include one or more tabs that are sized and configured to abut the backboard bracket to allow forces impacting the backboard to be transmitted to the backboard bracket. The strike plate may also include one or more flexural supports that are sized and configured to abut the backboard bracket to allow forces impacting the backboard to be transmitted to the backboard bracket. In addition, the strike plate may include one or more tabs and/or flexural supports that are spaced apart from the backboard bracket when no force is applied to the rebound surface, and the tabs and/or flexural supports contact the backboard bracket when a force is applied to the rebound surface. The tabs and/or flexural supports allow forces to be transmitted to the backboard bracket. Advantageously, because the backboard bracket may be connected to the goal support structure, forces can be directly transmitted from the strike plate to the backboard bracket and the goal support structure.

Still another aspect is a strike plate for a basketball goal assembly that may include a support structure, a backboard with a rebound surface, and a rim assembly. The strike plate preferably includes a main body portion with a front face that is sized and configured to be positioned adjacent to the rim assembly. The strike plate also preferably includes a rebound surface support that extends from the main body portion. The rebound surface support is desirably sized and configured to support at least a portion the rebound surface of the backboard. The strike plate may also include a lip that extends from the main body portion and is sized and configured to allow the strike plate to be attached to the backboard.

Preferably, the front face of the main body portion of the strike plate is disposed generally parallel to the rebound surface support.

Yet another aspect is a basketball goal assembly including a support pole, a goal support structure connected to the support pole, and a basketball goal connected to the goal support structure. The basketball goal desirably includes a backboard, a backboard bracket connected to the backboard, a strike plate connected to the backboard, and a rim assembly connected to the strike plate and the backboard bracket by one or more fasteners. Advantageously, the rim assembly may include a break-away type rim that pivots in response to a force applied to the rim.

A further aspect is basketball goal that includes a backboard with a frame and a rebound surface, and a strike plate connected to the backboard. The strike plate includes a main body portion with a front face and a rebound surface support that is sized and configured to support at least a portion the rebound surface of the backboard. The strike plate is preferably sized and configured to help prevent at least a portion of the rebound surface from undesirably deflecting when a force is applied to the rebound surface. The basketball goal may also include a rim assembly connected to the backboard support member.

Advantageously, the strike plate can be used to help prevent the rebound surface from undesirably bending or deflecting. In addition, the strike plate can be used to transmit forces from the rebound surface to the backboard bracket, which may improve the reliability and life of the backboard.

Significantly, the basketball goal assembly provides an effective, reliable support for a rebound surface of a basketball goal. In addition, the basketball goal assembly may enable more predictable and enhanced basketball play because of improved rebounding characteristics, and it allows a lightweight rebound surface to be used. Furthermore, the strike plate improves rebounding characteristics without requiring the use of additional frame elements that add to the cost, weight, and complexity of the system.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is directed towards a basketball goal assembly with an impact transmitting strike plate. The principles of the present invention, however, are not limited to basketball goal assemblies with impact transmitting strike plates. It will be understood that, in light of the present disclosure, the impacting transmitting strike plate disclosed herein can be successfully used in connection with other types of sporting equipment.

Additionally, to assist in the description of the basketball goal assembly with the impact transmitting strike plate, words such as top, bottom, front, rear, right and left are used to describe the accompanying figures. It will be appreciated, however, that the impact transmitting strike plate can be located in a variety of desired positions—including various angles, sideways and even upside down. A detailed description of the basketball goal assembly with the impact transmitting strike plate now follows.

Figure 1:
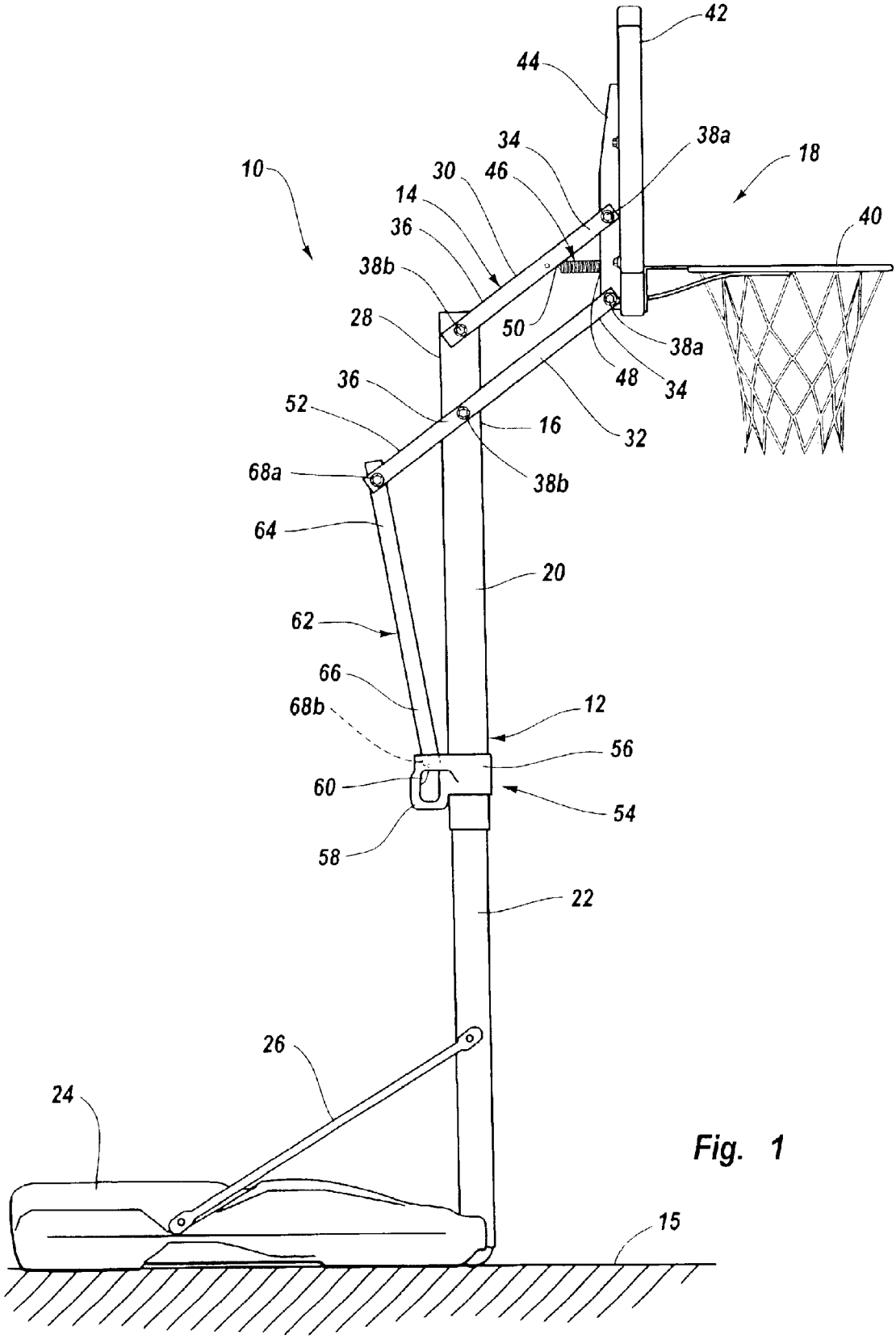
FIG. 1 is a side view of a basketball goal assembly in accordance with an embodiment of the present invention.

As seen in FIG. 1, an exemplary basketball goal assembly 10 is illustrated. The basketball goal assembly 10 shown in FIG. 1 allows the height of the assembly to be adjusted. It will be appreciated, however, that the height of the basketball goal assembly 10 does not have to be adjustable and basketball goal assembly 10 can have a fixed height. The basketball goal assembly 10 includes a support pole 12 that extends in a substantially vertical direction in relation to a playing surface 15. A goal support structure 14 is connected to a goal side 16 of the support pole 12 and a basketball goal 18 is attached to the goal support structure 14.

The goal support structure 14 preferably has a parallelogram shape and the goal support structure can preferably be deformed into a plurality of different configurations in which the basketball goal 18 is disposed at different heights above the playing surface 15. It will be appreciated that the basketball goal assembly 10 can have a variety of suitable shapes and configurations. For example, the height of the basketball goal assembly 10 does not have to be adjustable and the goal support structure does not have to have a configuration that is generally in the shape of a parallelogram. In addition, although the basketball goal assembly 10 shown in FIG. 1 is portable, it will be understood that the basketball goal assembly could also be held in a fixed or permanent position.

As shown in FIG. 1, the support pole 12 includes an upper pole section 20 and a lower pole section 22. The upper pole section 20 and lower pole section 22 are preferably connected by press fitting the lower pole section may into the upper pole section. This configuration may be utilized to make the basketball goal assembly 10 easier and more cost effective to package and to decrease the amount of required storage space. The support pole 12, however, may be constructed from a single section or multiple sections that are interconnected depending, for example, upon the intended use of the basketball goal assembly 10.

The lower pole section 22 of the support pole 12 may be connected to a support base 24 such that the support pole is held in a generally upright position. The support base 24 may include an internal cavity that selectively receives and retains ballast material (e.g., water, sand or the like) to support and stabilize the basketball goal assembly 10. A pair of rods 26 maybe incorporated to assist in securing the support pole 12 to the support base 24. As will be readily appreciated by those skilled in the art, there are a variety of other suitable ways to connect the support pole 12 to the support base 24. Preferably, the support pole 12 is attached to the support base 24 in such a manner that the center of gravity of the support base is located behind a back side 28 of the support pole 12. It will be understood, however, that the support pole 12 and support base 24 can be connected in any suitable manner and other suitable types of movable basketball support systems can also be utilized. Further, the support pole 12 may also be held in fixed or stationary position, such permanently mounting the pole to an in-ground support structure.

The goal support structure 14 of the basketball goal assembly 10 preferably includes an upper linkage arm 30 and a lower linkage arm 32, and each of the linkage arms have a proximal end 34 and a distal end 36. The proximal ends 34 of the upper and lower linkage arms 30, 32 are connected to the basketball goal 18. Preferably, the proximal ends 34 of the upper and lower linkage arms 30, 32 are connected to the basketball backboard 42 and, more preferably, to a backboard support member, such as a backboard bracket 44, of the basketball goal 18. As shown in FIG. 1, the backboard bracket 44 is preferably located near or on the rear face of the backboard 42 and a rim or hoop 40 is located near the front face of the backboard.

The proximal ends 34 of the upper and lower linkage arms 30, 32 are preferably pivotally attached to the basketball goal 18 by fasteners 38*a* (e.g., bolts, screws, rivets or the like) that are inserted through openings in the backboard bracket 44. The distal ends 36 of the upper and lower linkage arms 30, 32 are preferably pivotally attached to the support pole 12 by fasteners 38*b* (e.g., bolts, screws, rivets or the like) that are inserted through openings in the support pole. It will be appreciated that a variety of different types of fasteners and/or fastening methods are known in the art to pivotally attach the basketball goal 18 to the goal support structure 14 and to pivotally attach the goal support structure to the support pole. It will also be appreciated that the basketball goal 18 does not have to be pivotally attached to the goal support structure 14 if, for example, it is desired to secure the basketball goal in a fixed position.

The upper linkage arm 30, lower linkage arm 32, support pole 12 and the backboard bracket 44 preferably form at least a portion of the goal support structure 14, and these structures are preferably arranged in a parallelogram configuration. Advantageously, because the upper linkage arm 30 and the lower linkage arm 32 are pivotally mounted to the basketball goal 18 and support pole 12 in a parallelogram configuration, the goal support structure 14 can be adjusted into a plurality of different heights relative to the playing surface 15. Significantly, the backboard 42 remains generally vertically disposed and the rim 40 remains generally horizontally disposed even when the height of the basketball goal 18 is changed. It will be understood that the upper linkage arm 30, lower linkage arm 32, support pole 12 and backboard bracket 44, however, do not have to be arranged in a generally parallelogram configuration and other suitable types of structures may be used to position the basketball goal 18 at the desired height above the playing surface.

The basketball goal assembly 10 may include a counterbalance to facilitate adjustment of the goal support structure 14. The counterbalance, for example, may include a resistive member 46 that is connected to the goal support structure 14 and the resistive member may provide a force that substantially counterbalances the weight of the basketball goal 18. As shown in FIG. 1, the resistive member 46 may be a coil spring with sufficient rigidity and stiffness to resist the weight of the basketball goal 18. In particular, the resistive member 46 may have a proximal end 48 that is attached to the backboard bracket 44 and a distal end 50 that is attached to the upper linkage arm 30 of the goal support structure 14, but the resistive member could be attached to any suitable portions of the goal support structure and other suitable types of resistive members could be used. For example, linear springs, angular springs, leaf springs, hydraulic, pneumatic, or hybrid pistons, or the like could be attached between some combination of the upper linkage arm 30, the lower linkage arm 32, the support pole 12, and the backboard bracket 44. Advantageously, the counterbalancing provided by the resistive member 46 allows for adjustment of the height of the basketball goal 18 above the playing surface 15 with minimal effort. One skilled in the art will appreciate that other suitable counterbalances could also be used in connection with the basketball goal assembly 10.

As discussed above, the basketball goal assembly 10 is preferably adjustable in height and it includes at least one linkage arm 30, 32 with a leveraging extension 52 that extends beyond the back side 28 of the support pole 12. The leveraging extension 52 is preferably an integral part of the lower linkage arm 32 and it provides a leveraged point from which to adjust the height of the basketball goal 18. An extension arm 62 is attached to the end of the linkage arm 32 to allow the height of the basketball goal 18 to be adjusted. In particular, a first end 64 of the extension arm 62 is attached to the lower linkage arm 32 and a second end 66 of the extension arm is connected to an adjustment collar 54. Fasteners 68*a* and 68*b*, such as bolts, screws, rivets, or the like, may be used to connect the extension arm 62 to the lower linkage arm 32 and to the adjustment collar 54, respectively. The adjustment collar 54 includes a tubular portion 56 that generally encircles the support pole 12 and the adjustment collar is preferably slidably attached to the support pole. The adjustment collar 54 includes a handle portion 58 that is designed to be easily grasped and moved upward or downward by a user. The adjustment collar 54 may also have a trigger 60 that is formed of a durable, easily-molded material such as a polymer that allows the adjustment collar to move relative to the support pole 12. It will be understood that other suitable types of mechanisms and assemblies may also be used to adjust the height of the basketball goal 18.

Under normal playing conditions, the adjustment collar 54 is held in a fixed position with respect to the support pole 12 such that the basketball goal 18 is held in a fixed location. When the trigger 60 is depressed, however, the adjustment collar 54 is able to move along the length of the support pole 12 and that allows the height of the basketball goal 18 to be adjusted relative to the playing surface. In particular, when the adjustment collar 54 is moved in a downward direction, the goal support structure 14 raises the basketball goal 18 in relation to the playing surface 15. On the other hand, when the adjustment collar 54 is moved in an upward direction, the goal support structure 14 lowers the basketball goal 18 in relation to the playing surface 15.

As stated previously, the basketball goal assembly 10 shown in FIG. 1 is an exemplary embodiment of an adjustable basketball goal assembly, but other suitable types of adjustable and non-adjustable basketball assemblies may be used. In addition, the basketball goal assembly 10 may have other suitable configurations. For example, the first end 64 of the extension am 62 need not be connected to the leveraging extension 52, but may instead be pivotally connected to the upper linkage arm 30 or the lower linkage arm 32, between the fasteners 38*a* and the fasteners 38*b*. The handle portion 58 of the adjustment collar 54 may also be disposed on the front side 16 of the support pole 12, but positioning the handle on the back side 28 may be more desirable such that it does not interfere when playing basketball.

The basketball goal 18 includes a backboard 42 with a rebound member or surface that is preferably constructed from a lightweight and/or transparent material. As discussed in more detail below, the backboard 42 is preferably supported by the backboard bracket 44 and forces acting on the rebound surface are preferably transmitted to the backboard bracket, which are then dissipated through the remainder of the basketball goal assembly 10.

Figure 2:
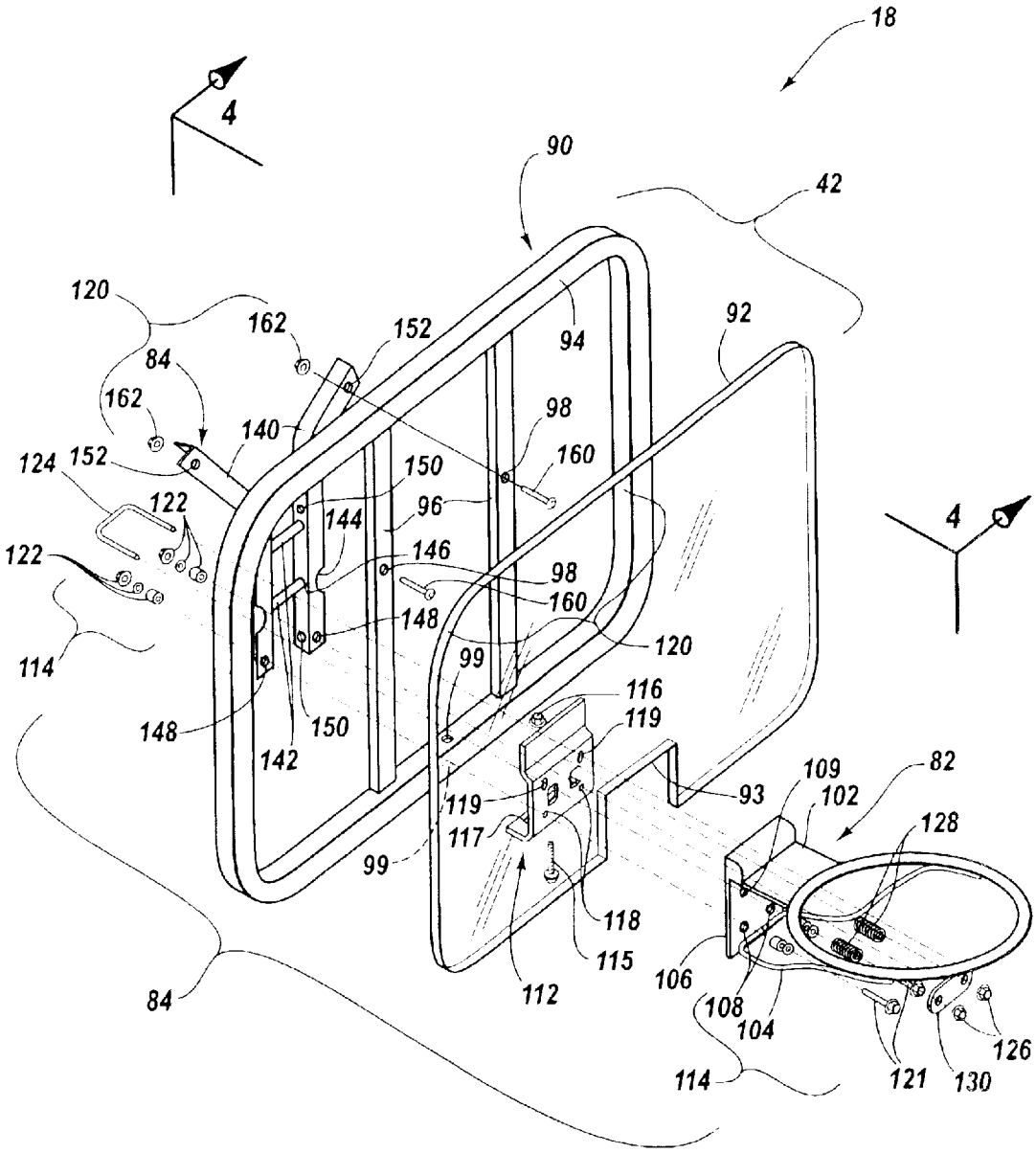
FIG. 2 is an enlarged, exploded perspective view of a portion of the basketball goal assembly shown in FIG. 1, illustrating the rim support assembly, rim assembly and backboard bracket.
Figure 3:
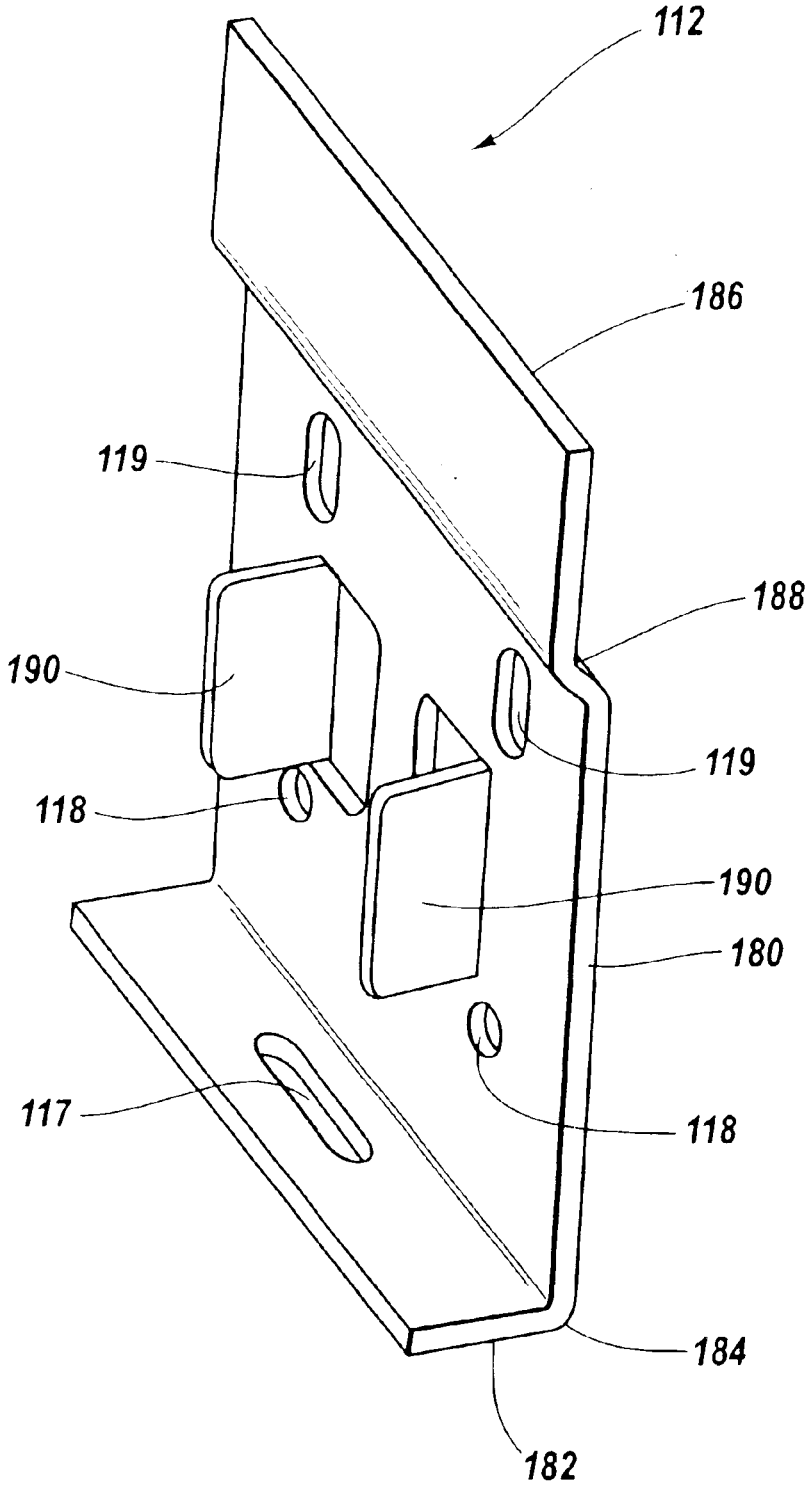
FIG. 3 is an enlarged perspective view of a portion of the basketball goal assembly shown in FIG. 2, illustrating the strike plate.
Figure 4:
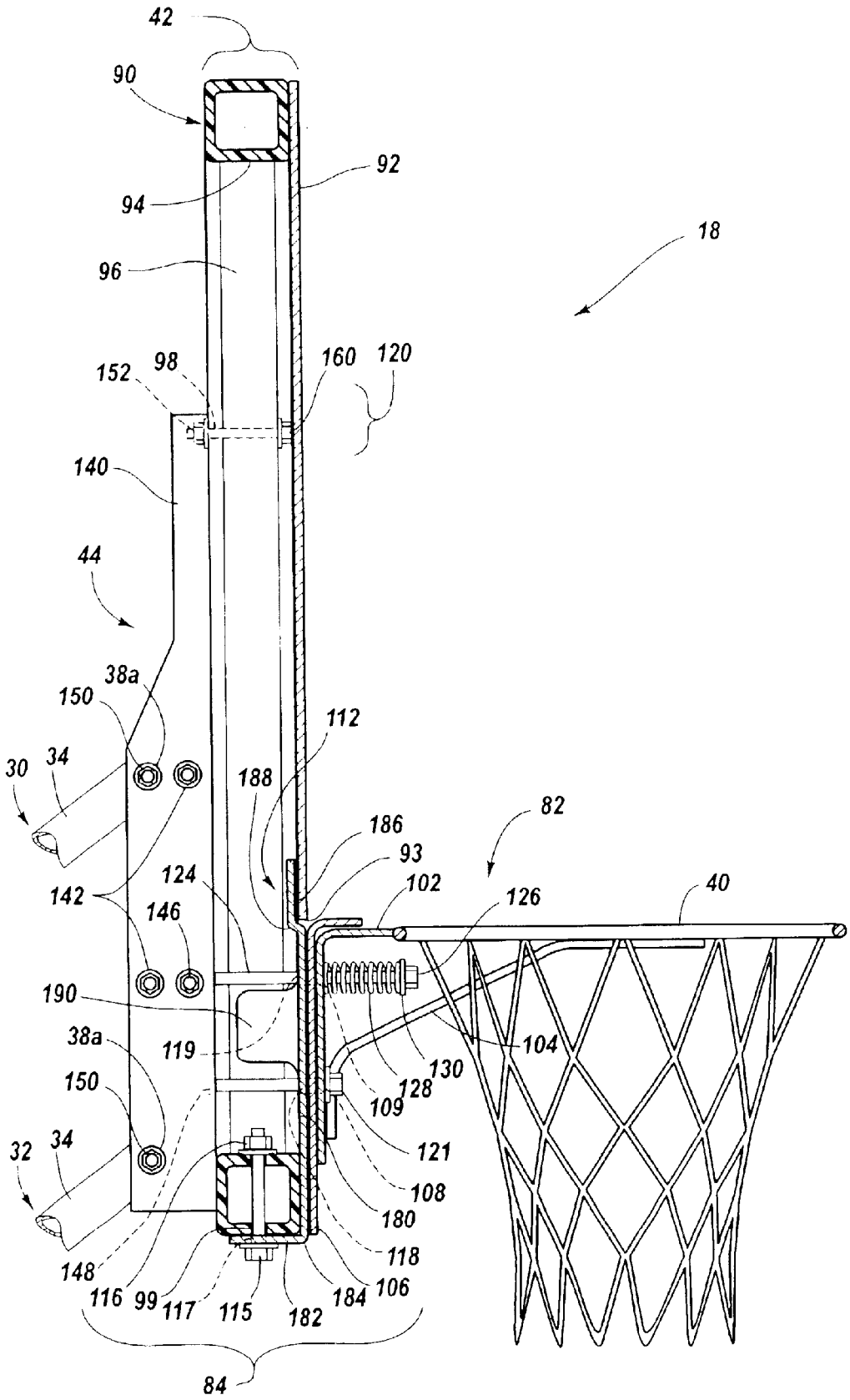
FIG. 4 is a partial cross-sectional side view of a portion of the basketball goal assembly shown in FIG. 2, illustrating the rim support assembly, rim assembly and backboard bracket in an assembled condition.
Figure 2:
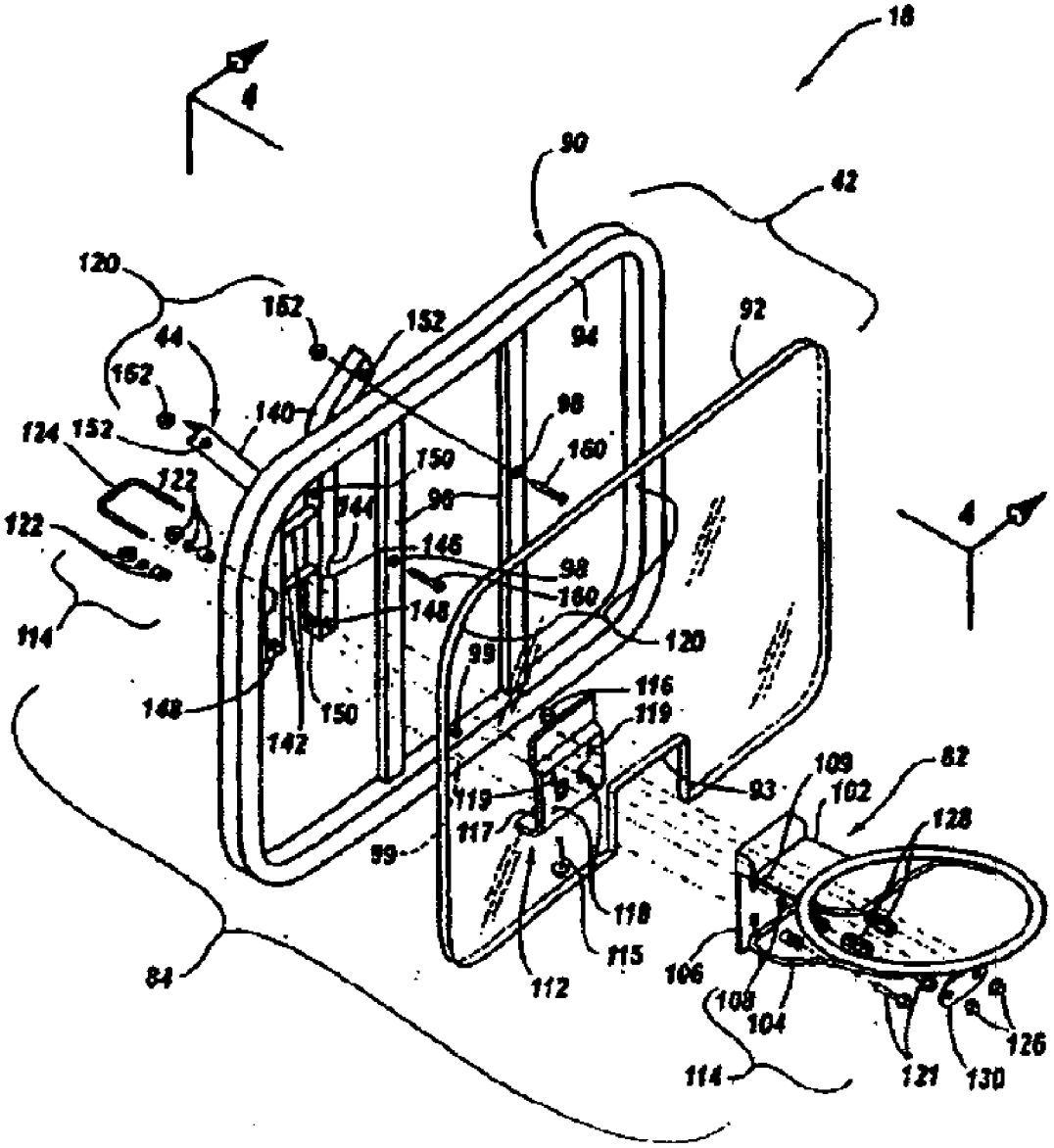
Figure 3:
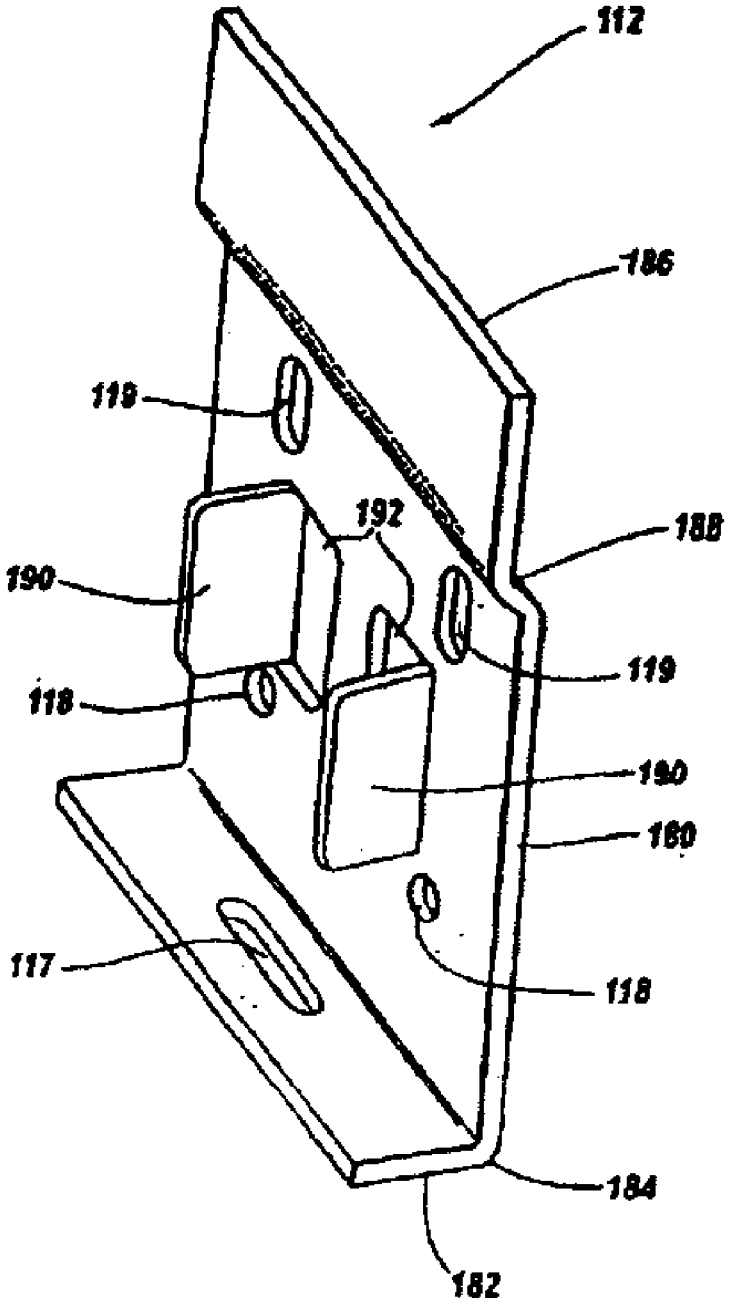

FIGS. 2 through 4 depict one embodiment of a basketball goal assembly 10 that allows forces to be transmitted from the rebound surface to the backboard bracket 44 and from the backboard bracket to the remainder of the basketball goal assembly. In particular, as shown in FIG. 2, the basketball goal 18 includes the backboard 42, a rim assembly 82, and a rim support assembly 84 that is designed to attach the rim assembly to the backboard via the backboard bracket 44. The backboard 42 includes a frame 90 that is preferably constructed of a sturdy, stiff material such as steel. The frame 90 can also be constructed from other suitable materials, such as plastic, with the desired properties. The frame 90 includes a circumferential portion 94 with two support struts 96 disposed within the circumferential portion 94 to provide additional support for the rebound surface 92. The support struts 96 include openings 98 to facilitate attachment of the frame 90 to the backboard bracket 44. Additionally, a pair of aligned openings 99, only one of which is visible in FIG. 2, may be disposed on either side of the bottom portion of the circumferential portion 94 of the frame 90. One skilled in the art will appreciate that the backboard 42 and circumferential portion 94 can have other suitable sizes and configurations depending, for example, upon the intended use of the basketball goal assembly 10.

A rebound member or surface 92 is attached to the frame 90. The rebound surface 92 preferably includes a cutout 93 that is sized and configured to receive the rim assembly 82, but the cutout may have other suitable sizes and configurations. The rebound surface 92 may be attached to the frame 90 through the use of fasteners (not shown), an adhesive, or the like.

The rim assembly 82 may be a conventional rim that is designed to remain in a stationary position or the rim assembly may be a "break-away" type rim that permits downward motion of the rim 40 to avoid damage to the rim or the backboard 42 during high impact maneuvers such as dunking the basketball. If the rim is a "break-away" type rim, the rim assembly 82 may include a number of components in addition to the rim 40. For example, the rim assembly 82 may include a rim plate 102 that has a generally L-shaped configuration and two or more struts 104 that extend from the rim 40 to the rim plate to provide additional support for the rim 40.

The rim assembly 82 preferably includes a backing plate 106 that abuts and partially covers at least a portion of the rim plate 102. Desirably, the backing plate 106 is configured to ensure that the rim plate 102 is unable to pinch a player's finger or thumb when the rim 40 is released. It will be appreciated that the backing plate 106 is optional and may simply be excluded if desired. The rim plate 102 and the backing plate 106 preferably each include a pair of lower openings 108 and a pair of upper openings 109 which, as discussed in more detail below, are generally aligned.

The rim support assembly 84 preferably includes the rim assembly 82, the backboard bracket 44, a strike plate 112, and a plurality of fasteners 114. The strike plate 112 is preferably attached to the circumferential portion 94 of the frame 90 via one or more fasteners 115 that pass through the openings 99 in the lower portion of the frame. The fasteners 115 may also pass through one or more openings 117 (which are generally hidden in FIG. 2) of the strike plate 112, to hold the strike plate 112 against the bottom portion of the frame 90.

The strike plate 112 includes a pair of lower openings 118 that are generally aligned with the lower openings 108 in the rim plate 102 and a pair of upper openings 119 that are generally aligned with the upper openings 109 of the rim plate. This allows the fasteners 114 to also pass through the openings 118, 119 in the strike plate 112 as they extend between the rim assembly 82 and the backboard bracket 44. Advantageously, the strike plate 112 may serve to maintain the desired separation between the backboard bracket 44 and the rim assembly 82. For example, the strike plate 112 may maintain the rim assembly 82 in a desired location relative to the cutout 93.

The fasteners 114 may include bolts 121 that are inserted through the lower openings 118 in the rim plate 102 and corresponding openings in the backboard bracket 44. Nut assemblies 122 may then be connected to the bolts 121 to secure the bolts in fixed positions. A generally U-shaped bolt 124 may pass in the opposite direction, i.e., from the backboard bracket 44 to the rim plate 102, and the ends of the U-bolt may be secured via nuts 126. One or more linear springs 128 linear springs 128 are preferably be disposed between the rim plate 102 and the nuts 126, and a retention plate 130 may be positioned between the linear springs 128 and the nuts 126 if desired. This allows the upper portion of the rim plate 102 to extend, move or pivot away from the backing plate 106 to enable the rim 40 to tilt downwardly when a weight or force is applied to the rim, thereby providing a "break-away" type rim.

The backboard bracket 44 includes a pair of arms 140 that are attached together via braces 142. Each of the arms 140 preferably has a generally L-shaped cross section that is designed to provide strength against bending and to permit easy attachment of the fasteners 38*a*, 114, 120. It will be appreciated, however, that the arms 140 and braces 142 can have any suitable shape and configuration. For example, the braces 142 may be steel tubes through which a bolt (not shown in the accompanying figures) can be inserted to keep the arms 140 in a spaced apart configuration. It will also be appreciated that the arms 140 and braces 142 can be formed as an integral, one-piece member or multiple pieces that can be attached in any suitable manner.

Each of the arms 140 of the backboard bracket 44 desirably includes a notch 144 that is designed to permit passage of the generally U-shaped bolt 124. Additionally, each of the arms 140 may include an opening 146 through which the generally U-shaped bolt 124 can be inserted. For example, the U-bolt 124 may be inserted into the openings 146 by positioning the arms 140 next to each other and inserting the U-bolt prior to attachment of the braces 142. Thus, the U-bolt 124 may extend through the notches 144 and openings 146 in the arms 140 of the backboard bracket 44, through the upper openings 119 in the strike plate, and through the upper openings 109 in the rim assembly 82. As discussed above, linear springs 128 are disposed proximate the ends of the U-bolt 124 and the springs are held in the desired position by the retention plate 130 and nuts 126. Advantageously, this configuration allows the rim 40 to move, deflect or pivot in response to a force being applied to this rim and this creates a break-away type rim. One skilled in the art will appreciate that other suitable types of break-away rims may also be used in connection with the basketball goal assembly 10.

The arms 140 may also include bolt openings 148 that are sized and configured to receive the bolts 121 that extend through the lower openings 108 in the rim assembly 82 and the lower openings 118 in the strike plate 112. Thus, the bolts 121 can be used to connect the rim assembly 82 to the strike plate 112 and the arms 140 of the backboard bracket 44. In addition, the arms 140 may have linkage arm openings 150 through which the proximal ends 34 of the linkage arms 30, 32 of the goal support structure 14 can be attached to the backboard bracket 44. In particular, the fasteners 38*a* (which are shown in FIG. 1) can be used to attach the linkage arms 30, 32 of the goal support assembly 14 to the arms 140 of the backboard bracket 44. Further, the arms 140 of the backboard bracket 44 may include backboard attachment openings 152 to facilitate attachment of the backboard bracket to the frame 90 of the backboard 42. The backboard attachment openings 152 are desirably aligned with the openings 98 in the support struts 96 to allow the backboard bracket 44 to be securely attached to the backboard frame 90 by the fasteners 120. In certain configurations, the lower portion of the backboard bracket 44 need not be attached directly to the frame 90 because the fasteners 114 used to attach the rim assembly 82 to the strike plate 112 and the backboard bracket 44 may hold the lower portion of the backboard bracket in a fixed position relative to the frame. One or more fasteners, however, may be used to connect the lower portion of the backboard bracket 44 to the frame 90 of the backboard 42. One skilled in the art will understand that the backboard bracket 44 may be attached to the backboard 42, strike plate 112 and rim assembly 82 using any suitable type of fasteners. In addition, these and other components of the basketball goal assembly may also be attached using adhesives, rivets, welding, etc. or by forming one or more of these parts as a unitary structure.

The strike plate 112 is desirably sized and configured to help support the rebound surface 92 in a generally fixed position and to receive forces applied against the rebound surface. In particular, the strike plate 112 preferably helps prevent the center portion of the rebound surface 92 from undesirably deflecting or bending, and it allows forces impacting the rebound surface to be transmitted to the backboard bracket 44.

As shown in FIG. 3, the strike plate 112 includes a face 180 that is preferably generally vertically disposed when the strike plate is attached to the frame 90. As discussed above, the lower openings 118 and the upper openings 119 are disposed on the face 180 to receive the fasteners 114 and U-bolt 124 respectively. The openings 118, 119 are one type of rim assembly attachment feature and one of ordinary skill in the art will recognize that the strike plate 112 may be attached to the rim assembly 82 by any suitable type of rim attachment feature, such as clips, clamps, cantilevered fastening posts, and the like. In addition, the upper openings 119 may be slots to permit the U-bolt 124 to pivot with the rim plate 102 when the rim 40 is deflected downwardly. Advantageously, if the U-bolt 124 is permitted to pivot freely within the upper openings 119, the tensile load exerted on the U-bolt by the rim assembly 82 will be transmitted to the backboard bracket 44 rather than to the strike plate 112.

The strike plate 112 also includes a lip 182 that extends generally perpendicular to the face 180 and it is preferably designed to contact a lower portion of the frame 90. The lip 182 is joined with the face 180 via a bend 184 and the lip includes the opening 117 that allows the fastener 115 to secure the strike plate 112 to the lower portion of the frame 90. The opening 117 is desirably in the form of a slot to permit some variance in the horizontal positioning of the strike plate 112 along the bottom portion of the frame 90. Therefore, the opening 99 in the bottom portion of the frame 90 does not have to be precisely aligned with the opening 117 to receive the fastener 115. Advantageously, this allows the basketball goal 18 to be more quickly and easily assembled.

In addition, the strike plate 112 includes a rebound surface support 186 that is sized and configured to support at least a portion of the rebound surface 92. The rebound surface support 186 is desirably positioned substantially parallel to and spaced apart from the face 180 of the strike plate 112. In particular, the rebound surface support 186 is preferably positioned slightly rearward of the face 180 via an S-shaped curve 188 that joins the face with the rebound surface support. The face 180 of the strike plate 112 is preferably sized and configured to fit within and nearly or completely fill the cutout 93 in the rebound surface 92, and the rebound surface support 186 is preferably sized and configured to extend behind at least a portion of the rebound surface 92. As best seen in FIGS. 2 and 4, the rebound surface support 186 preferably supports the center portion of the rebound surface 92 immediately adjacent to the cutout 93. Advantageously, this allows the rebound surface support 186 to support the center portion of the rebound surface 92 and it allows forces impacting the rebound surface to be transmitted to the strike plate 112. It will be appreciated, however, that the strike plate 112 and rebound surface support 186 can have other suitable sizes and configurations depending, for example, upon the size and configuration of the cutout 93, rebound surface 92 and/or backboard 42. In addition, the strike plate 112 may be size and configured to support other desired portions of the rebound surface 92.

The strike plate 112 desirably includes one or more flexural supports that are designed to reduce flexing or bending of the face 180. The flexural supports, for example, may abut another component such as the backboard bracket 44 to help prevent bending of the strike plate 112. The flexural supports may also include separate items that can be attached to the strike plate 112, such as fasteners, spacers, or the like, for purposes such as increasing the rigidity of the strike plate. Additionally, the flexural supports may include one or more tabs or flanges that are integrally formed within the strike plate 112.

As best seen in FIGS. 3 and 4, the flexural supports are preferably a pair of tabs 190 that extend rearwardly from the face 180 of the strike plate 112. The tabs 190 may be formed by cutting three-sided tab openings 192 into the face 180 of the strike plate 112 and folding the tabs 190 into a substantially perpendicular position relative to the face 180. The tabs 190 are preferably sized and configured to contact or abut the backboard bracket 44, but the tabs 190 can have any desired size and length, and the tabs may be configured to contact other portions of the basketball goal assembly 10.

The tabs 190 preferably abut the backboard bracket 44, either continuously or periodically, to allow forces impacting the rebound surface 92 to be transmitted to the backboard bracket 44. For example, if the tabs 190 abut the backboard bracket 44, then forces from a basketball impacting the rebound surface 92 can be directly transmitted from the strike plate to the backboard bracket 44. On the other hand, if the tabs 190 are positioned near or proximate the backboard bracket 44, then forces from a basketball impacting the rebound surface 92 may first cause the tabs to contact the backboard bracket and then forces can be transmitted to the backboard bracket.

As shown in FIG. 4, the strike plate 112 is preferably positioned such that the rebound surface support 186 is disposed directly behind a portion of the rebound surface 92 to receive forces caused by a basketball or other objects impacting the rebound surface. In addition, the tabs 190 of the strike plate 112 preferably extend rearwardly such that they abut the backboard bracket 44. It will be appreciated that the rebound surface support 186, however, does not have to abut the rebound surface 92. For example, the rebound surface support 186 can be spaced apart from the rebound surface 92 such that the rebound surface will deflect slightly before abutting the rebound surface support. Additionally, as discussed above, the tabs 190 do not have to abut the backboard bracket 44.

Advantageously, the rebound surface support 186 of the strike plate 112 supports the rebound surface 92 in a generally fixed position, which helps prevent the rebound surface from undesirably bending or deflecting when struck by a basketball or other objects. This creates a backboard 42 with realistic and predictable rebounding characteristics. Additionally, the strike plate 112 allows forces impacting the rebound surface 92 to be transmitted directly to the backboard bracket 44. This helps reduce stress on other portions of the backboard 42, such as the circumferential portion 94 of the frame 90 and rebound surface 92, which may increase the reliability and expected life span of the backboard. Further, the strike plate 112 allows the rim assembly 82 to be positioned in the desired location relative to the backboard 42 and it allows the rim assembly 82 to be securely connected to the backboard bracket 44.

Significantly, the strike plate 112 allows the rebound surface 92 to be effectively and efficiently supported, which reduces undesirable deflection of the rebound surface and allows a more enjoyable game of basketball to be played. The strike plate 112 also allows forces to be directly absorbed by the backboard bracket 44, which may increase the durability and sturdiness of the basketball goal 18.

In addition, the basketball goal 18 can be easily assembled. For example, the U-bolt 124 may first be inserted through the U-bolt openings 146 of the unconnected arms 140 of the backboard bracket 44. The arms 140 of the backboard bracket 44 may then be connected together via the braces 142. The backboard bracket 44 may then be attached to the frame 90 of the backboard 42 by the fasteners 120. The strike plate 112 may then be positioned relative to the frame 90 by inserting the U-bolt 124 through the upper holes 119 in the strike plate. The strike plate 112 is preferably secured to the frame 90 by the fastener 115 that extends through the opening 99 in the lower portion of the frame.

The backing plate 106 and the rim plate 102 of the rim assembly 82 are then positioned relative to the strike plate 112 such that the U-bolt 124 extends through the upper openings 109 in the backing plate and the rim plate. The fasteners 114 are then used to connect the rim assembly 82, the strike plate 112 and the backboard bracket 44. The springs 128 and then the retention plate 130 are then inserted over the ends of the U-bolt 124, and the nuts 126 may then be connected to the ends of the U-bolt 124. It will be appreciated that the nuts 126 may be positioned in a desired location to place a predetermined load on the springs 128. Thus, by placing a predetermined load on the springs 128, the amount of force required to move or deflect the rim 40 can be determined. Advantageously, this configuration allows the force on the springs 128 and the corresponding force required for deflecting the rim 40 to be adjusted.

The rebound surface 92 is then positioned relative to the frame 90 such that the strike plate 112 protrudes through the cutout 93. As mentioned previously, the rebound surface 92 may be attached to the frame 90 through the use of fasteners, adhesives, or the like. The basketball goal 18 may then be pivotally attached to the proximal ends 34 of the linkage arms 30, 32 of the goal support structure 14 via the fasteners 38*a*. The distal ends 36 of the linkage arms 30, 32 are preferably attached to the support 12 by fasteners 38*b* and the other portions of the basketball goal assembly 10 may be assembled according to methods known in the art.

Of course, the basketball goal 18 may also be assembled in a variety of alternative ways and the steps described above may be reordered to form several different assembly or subassembly methods, and one or more of the steps may be combined, if desired. For example, one alternative way of assembling the basketball goal 18 may be to use the fasteners 114 to connect the rim assembly 82, the strike plate 112 and the backboard bracket 44 prior to attachment of the backboard bracket to the frame 90. Additionally, the rebound surface 92 may be attached to the frame 90 before the strike plate 112 is attached to the frame. One of ordinary skill in the art will recognize that numerous other assembly methods may be applied used to assemble the basketball goal 18 and the basketball goal assembly 10.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball system comprising:

a support structure including a support pole;

a goal support structure connected to the support structure;

a backboard bracket connected to the goal support structure;

a backboard connected to the backboard bracket, the backboard including a frame and a rebound member, the rebound member including an opening;

a strike plate at least partially disposed within the opening in the rebound member of the backboard, the strike plate including a front face and a rear face;

a rebound surface support extending upwardly from the strike plate, the rebound surface support being sized and configured to contact a center portion of the rebound member to help prevent the center portion of the rebound member from deflecting, the rebound surface support being disposed generally parallel to the front face of the strike plate; and a rim assembly connected to the front face of the strike plate.

2. The basketball system as in claim 1, further comprising one or more tabs extending generally rearwardly from the rear face of the strike plate, the tabs being sized and configured to abut the backboard bracket to allow forces applied to the strike plate to be directly transmitted to the backboard bracket.

3. The basketball system as in claim 1, further comprising one or more generally aligned openings in the rim assembly, in the strike plate and in the backboard bracket; and further comprising one or more fasteners disposed in the generally aligned openings to interconnect the rim assembly, the strike plate and the backboard bracket.

4. The basketball system as in claim 1, further comprising one or more fasteners interconnecting the rim assembly, the strike plate and the backboard bracket so that forces applied to the rim assembly are directly transmitted to the backboard bracket and not the backboard.

5. A basketball system comprising:

a support structure including a support pole;

a goal support structure connected to the support structure;

a backboard bracket connected to the goal support structure;

a backboard connected to the backboard bracket, the backboard including a frame and a rebound member, the rebound member including an opening;

a strike plate at least partially disposed within the opening in the rebound member of the backboard, the strike plate including a front face and a rear face;

one or more tabs extending generally rearwardly from the rear face of the strike plate, the tabs being sized and configured to abut the backboard bracket to allow forces applied to the strike plate to be directly transmitted to the backboard bracket; and a rim assembly connected to the front face of the strike plate.

6. The basketball system as in claim 5, further comprising a rebound surface support that extends generally upwardly from the strike plate, the rebound support surface being sized and configured to contact a center portion of the rebound member to help prevent the center portion of the rebound member from deflecting, the rebound surface support being disposed generally parallel to the front face of the strike plate.

7. The basketball system as in claim 5, further comprising one or more generally aligned openings in the rim assembly, in the strike plate and in the backboard bracket; and further comprising one or more fasteners disposed in the generally aligned openings to interconnect the rim assembly, the strike plate and the backboard bracket.

8. The basketball system as in claim 5, further comprising one or more fasteners interconnecting the rim assembly, the strike plate and the backboard bracket so that forces applied to the rim assembly are directly transmitted to the backboard bracket and not the backboard.

9. A basketball system comprising:

a support structure including a support pole;

a goal support structure connected to the support structure;

a backboard bracket connected to the goal support structure, the backboard bracket including one or more openings;

a backboard connected to the backboard bracket, the backboard including a frame and a rebound member, the rebound member including an opening;

a strike plate at least partially disposed within the opening in the rebound member of the backboard, the strike plate including a front face, a rear face and one or more openings extending through the front and rear faces;

a rim assembly including one or more openings, the openings in the rim assembly, the strike plate and the backboard bracket being generally aligned; and one or more fasteners disposed in the generally aligned openings in the rim assembly, the strike plate and the backboard bracket to interconnect the rim assembly, the strike plate and the backboard bracket so that forces applied to the rim assembly are directly transmitted to the backboard bracket and not the backboard.

10. The basketball system as in claim 9, further comprising a rebound surface support that extends generally upwardly from the strike plate, the rebound support surface being sized and configured to contact a center portion of the rebound member to help prevent the center portion of the rebound member from deflecting, the rebound surface support being disposed generally parallel to the front face of the strike plate.

11. The basketball system as in claim 9, further comprising one or more tabs extending generally rearwardly from a rear face of the strike plate, the tabs being sized and configured to abut the backboard bracket to allow forces applied to the strike plate to be directly transmitted to the backboard bracket.

* * * * *

UNITED STATES PATENT AND TRADEMARK OFFICE

CERTIFICATE OF CORRECTION

PATENT NO. : 6,824,481 B1
DATED : November 30, 2004
INVENTOR(S) : Nye et al.

It is certified that error appears in the above-identified patent and that said Letters Patent is hereby corrected as shown below:

Title page, illustrating figure(s) should be deleted, and substitute therefore, the title page illustrating figure(s). (attached)

Delete drawing sheets 2 & 3, and substitute therefore, drawing sheets 2 & 3. (attached)

Column 2,
Line 19, change “basketballs” to -- backboards --
Line 49, before “use” insert -- to --

Column 3,
Line 6, before “professional” insert -- a --

Column 4,
Lines 29 and 52, after “portion” insert -- of --
Line 48, before “basketball” insert -- a --

Column 5,
Line 19, change “limits” to -- limit --

Column 6,
Line 18, after “section” remove “may”
Line 32, after “26” change “maybe” to -- may be --
Line 44, before “permanently” insert -- as --

Column 12,
Line 2, change “size” to -- sized --

UNITED STATES PATENT AND TRADEMARK OFFICE

CERTIFICATE OF CORRECTION

PATENT NO. : 6,824,481 B1
DATED : November 30, 2004
INVENTOR(S) : Nye et al.

It is certified that error appears in the above-identified patent and that said Letters Patent is hereby corrected as shown below:

Column 13,
Line 45, after "support" insert -- pole --
Line 61, before "used" remove "applied"

Signed and Sealed this

Twenty-fourth Day of May, 2005

JON W. DUDAS
*Director of the United States Patent and Trademark Office*

(12) United States Patent
Nye et al.

(10) Patent No.: US 6,824,481 B1
(45) Date of Patent: Nov. 30, 2004

(54) IMPACT TRANSMITTING STRIKE PLATE FOR A BASKETBALL GOAL ASSEMBLY

(75) Inventors: S. Curtis Nye, Clinton, UT (US); David C. Winter, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/319,970

(22) Filed: Dec. 16, 2002

Related U.S. Application Data

(60) Provisional application No. 60/340,195, filed on Dec. 14, 2001.

(51) Int. Cl.[7] ..... A63B 63/08

(52) U.S. Cl. ..... 473/481

(58) Field of Search ..... 473/481, 433, 473/472, 479, 482–488, 48; 248/640, 690–691, 672; 52/508–511; 404/10

(56) References Cited

U.S. PATENT DOCUMENTS

| | | | | |
|---|---|---|---|---|
| 1,924,811 | A | | 8/1933 | Schulz |
| 2,986,395 | A | | 5/1961 | Sheftel |
| 3,329,427 | A | | 7/1967 | Bearson |
| 3,427,025 | A | | 2/1969 | Procter |
| 3,586,324 | A | | 6/1971 | Bearson |
| 3,765,676 | A | | 10/1973 | Bearson et al. |
| 3,788,642 | A | | 1/1974 | Matras et al. |
| 3,841,631 | A | | 10/1974 | Dolan |
| 4,111,420 | A | | 9/1978 | Tyner |
| 4,285,518 | A | * | 8/1981 | Pearo ..... 473/481 |
| 4,320,896 | A | * | 3/1982 | Engle et al. ..... 473/481 |
| 4,330,101 | A | | 5/1982 | Andersen |
| 4,395,040 | A | | 7/1983 | White |
| 4,438,923 | A | | 3/1984 | Engle et al. |
| 4,441,709 | A | | 4/1984 | Schroeder et al. |
| 4,583,732 | A | | 4/1986 | Allen |
| 4,676,503 | A | | 6/1987 | Mahoney |
| 4,723,777 | A | | 2/1988 | Jolly |
| 4,781,375 | A | | 11/1988 | Nye |
| 4,798,381 | A | | 1/1989 | Dadbeh |
| 4,801,142 | A | | 1/1989 | Friesen |
| 4,805,904 | A | | 2/1989 | Nye |
| 4,846,469 | A | | 7/1989 | Nye |
| 4,881,734 | A | | 11/1989 | Nye |
| 5,037,092 | A | * | 8/1991 | Blackburn ..... 473/481 |
| 5,066,007 | A | | 11/1991 | Niver |
| 5,106,084 | A | | 4/1992 | Vaught |
| 5,211,393 | A | | 5/1993 | Rolffs et al. |
| 5,255,910 | A | * | 10/1993 | Simonseth ..... 473/481 |
| 5,318,289 | A | | 6/1994 | Mahoney et al. |
| D350,797 | S | | 9/1994 | Curtis |
| 5,375,835 | A | | 12/1994 | Van Nimwegen et al. |
| D362,881 | S | | 10/1995 | Schickert et al. |
| 5,464,207 | A | | 11/1995 | Boitano |
| 5,465,957 | A | | 11/1995 | Schroeder |
| 5,478,068 | A | | 12/1995 | Schroeder |
| 5,503,390 | A | | 4/1996 | Hall |
| 5,573,237 | A | | 11/1996 | Van Nimwegen et al. |
| 5,586,759 | A | | 12/1996 | Fitzsimmons et al. |
| 5,601,284 | A | | 2/1997 | Blackwell et al. |

(List continued on next page.)

*Primary Examiner*—Steven Wong
*Assistant Examiner*—M. Chambers
(74) *Attorney, Agent, or Firm*—Workman Nydegger

(57) ABSTRACT

A basketball goal assembly includes a basketball goal with a strike plate. The strike plate preferably includes a rebound surface support that is sized and configured to help prevent the backboard from undesirably flexing or bending. In addition, the strike plate may allow forces to be directly transmitted from the backboard to other structures such as a backboard bracket or goal support structure. The strike plate may also have one or more flexural supports that brace the strike plate against flexure so that impact received from the rebound surface via the rebound surface support does not excessively bend the strike plate.

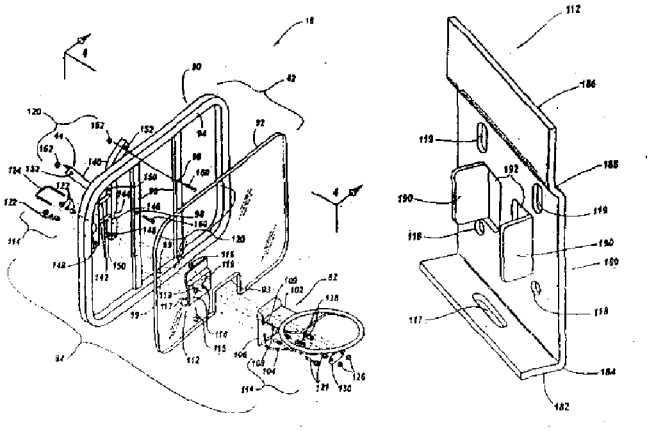

11 Claims, 4 Drawing Sheets